US010463096B2

(12) United States Patent
Smith et al.

(10) Patent No.: US 10,463,096 B2
(45) **Date of Patent: *Nov. 5, 2019**

(54) MODULAR INTERCHANGEABLE NECKTIE WITH SYNTHETIC KNOT AND MAGNETIC ATTACHMENT MEANS

(71) Applicant: MODERN TIE LLC, South Ogden, UT (US)

(72) Inventors: Ryan Smith, South Ogden, UT (US); Daniel Smith, South Ogden, UT (US)

(73) Assignee: Modern Tie LLC, South Ogden, UT (US)

( * ) Notice: Subject to any disclaimer, the term of this patent is extended or adjusted under 35 U.S.C. 154(b) by 69 days.

This patent is subject to a terminal disclaimer.

(21) Appl. No.: 15/822,142

(22) Filed: Nov. 25, 2017

(65) Prior Publication Data

US 2019/0159535 A1 May 30, 2019

(51) Int. Cl.

| | |
|---|---|
| ***A41D 25/00*** | (2006.01) |
| ***A41D 25/02*** | (2006.01) |
| ***A41D 1/00*** | (2018.01) |
| ***H04R 1/02*** | (2006.01) |
| ***A41F 1/00*** | (2006.01) |

(52) U.S. Cl.

CPC ..... *A41D 25/005* (2013.01); *A41D 1/002* (2013.01); *A41D 25/027* (2013.01); *A41F 1/002* (2013.01); *H04R 1/02* (2013.01); *H04R 2201/023* (2013.01); *H04R 2420/07* (2013.01)

(58) Field of Classification Search

CPC ..... A41D 25/005; A41D 1/002; A41D 25/027

See application file for complete search history.

(56) References Cited

U.S. PATENT DOCUMENTS

| | | | | | |
|---|---|---|---|---|---|
| 1,431,268 | A | * | 10/1922 | Spiegler | A41D 25/04 2/155 |
| 3,235,880 | A | * | 2/1966 | Hypps | A41D 25/08 24/66.3 |
| 3,284,807 | A | * | 11/1966 | Espino | A41D 25/02 2/153 |
| 4,318,189 | A | * | 3/1982 | Intengan | A41D 25/025 2/144 |
| 4,368,544 | A | * | 1/1983 | Smith | A41D 25/025 2/153 |
| 5,084,916 | A | * | 2/1992 | Austin | A41D 25/02 2/149 |
| 5,088,120 | A | * | 2/1992 | Yen | A41D 25/025 2/150 |
| 5,216,757 | A | * | 6/1993 | Dorkin | A41D 25/022 2/144 |
| 5,493,731 | A | * | 2/1996 | Amnott | A41D 25/022 2/148 |
| 5,774,893 | A | * | 7/1998 | Torres | A41D 25/025 2/148 |
| 5,836,018 | A | * | 11/1998 | Lee | A41D 25/04 2/144 |

(Continued)

*Primary Examiner* — Richale L Quinn

(74) *Attorney, Agent, or Firm* — Kirton McConkie; Brian Tucker

(57) ABSTRACT

A modular necktie with simulated knot detachably affixable to a fabric stem and elongated fabric tie, the knot enclosure comprising a microphone and wireless transmission means in some embodiments. The knot enclosure may comprise a ratcheting mechanism and may be formed from a plurality of interconnected components.

20 Claims, 15 Drawing Sheets

(56) References Cited

U.S. PATENT DOCUMENTS

| | | | | |
|---|---|---|---|---|
| 6,216,275 | B1 * | 4/2001 | Lee | A41D 25/003 2/144 |
| 6,363,533 | B1 * | 4/2002 | DeLuca | A41D 25/02 2/145 |
| 7,028,342 | B1 * | 4/2006 | Nordstrom | A41D 1/04 2/119 |
| D741,043 | S * | 10/2015 | Stikeleather | D2/600 |
| 9,737,099 | B1 * | 8/2017 | Khoury | A41D 25/025 |
| 9,781,961 | B2 * | 10/2017 | Erickson | A41D 25/10 |
| 10,117,474 | B1 * | 11/2018 | Smith | A41D 25/005 |

* cited by examiner

MODULAR INTERCHANGEABLE NECKTIE WITH SYNTHETIC KNOT AND MAGNETIC ATTACHMENT MEANS

BACKGROUND OF THE INVENTION

Field of the Invention

This invention relates to neckties and menswear and more particularly relates to detachable synthetic neckties.

Description of the Related Art

Neckties are well known in the art and have become a staple of common business attire. Conventional neckties comprise an elongated strip of fabric commonly tied at the neck using knots known to those of skill in the art, including the Windsor knot, the Christensen knot, the Merovingian knot, the small knot, and the like. Other types of neckties also proliferate in the art including bowties.

Neckties have evolved slowly over centuries and continue to evolve with provision of the present invention. Roman soldiers adorned themselves in scarves and neckwear as part of their uniforms and the concept of the necktie in menswear grew slowly, through Europe subsequently. In medieval baffles, including the Thirty Years' War and the Baffle of Steenkerque, officers commonly wrapped cravats around their necks and twisted the ends of the fabric cravats together, passing the twisted portions through a buttonhole. These cravats were sometimes used in the battlefield as tourniquets.

With the industrial revolution, cravats gave way to leather collars and finally to more traditional neckties arraying a series of knots and styles. These traditional neckties are not entirely, efficient, however. Traditional neckties still include the collar band, which is uncomfortable particularly in the heat, and are difficult and time consuming to tie. The collar band is useless and not even visible under the collar. It can be difficult to interchange traditional neckties and these inefficiencies have given way to abandonment of the necktie altogether by some professionals in hot or casual business environments.

Previous attempts to remedy these inefficiencies have been made in the art, including with the evolution of "clip-on" neckties, which eliminate the neckband of the tie acrd provide alternate means of collar attachment which simulates the Windsor knot. Clip-on neckties often show the clip, do not allow interchange of the elongated fabric portion of the tie, do not allow customizable knots, and do not include simulated knots beyond those previously known in the art. As the art, stylistic preferences of wearers, and manufacturing technologies continue to evolve, so too do neckties.

It is desirable to provide to the modern man a more efficient necktie with modularized, rapidly-interchangeable components adaptable to meet a variety of stylistic and aesthetic preferences, which makes use of improved manufacturing and design technologies.

SUMMARY OF THE INVENTION

From the foregoing discussion, it should be apparent that a need exists for a modular, interchangeable necktie with rapid detachment means.

Beneficially, such an apparatus would overcome many of the difficulties of the prior art by providing a necktie in which the fabric and knot are rapidly-configured to almost any wearer preferences or specification and which is not uncomfortable.

The present invention has been developed in response to the present state of the art, and in particular, in response to the problems and needs in the art that have not yet been fully solved by currently available apparati and methods. Accordingly, the present invention has been developed to provide a modular necktie comprising: a simulated knot having a declined rearward surface, the declined rearward surface defining a recess for receiving a magnetic element, the simulated knot defining a non-cylindrical attachment channel for receiving a fabric stem, the simulated knot affixable to one of a shirt collar and collar band; a fabric stem adapted to affix at a distal end to an elongated necktie and a proximal end to the knot enclosure, the fabric stem comprising: a noncylindrical proximal head adapted to engage the attachment channel, the proximal head comprising attachment means; a shank; a terminal fastener adapted to fasten to a fabric tie.

The fabric stem may further comprise a plurality of bulbous flanges. The proximal head of fabric stem may further comprise magnetic element for forming a magnetic dipole bond with a cooperating magnetic element in the knot enclosure.

The knot enclosure may further comprise, in some embodiments, a magnetic element for forming a magnetic dipole bond with a cooperating magnetic element in the fabric stem.

An exterior surface of the knot enclosure may be faceted. The knot enclosure may define a cylindrical attachment recess.

A floor of the cylindrical attachment recess may define a magnetic attachment recess. The modular necktie may further comprise an elongated strip of fabric forming a tie affixed to the fabric stem.

The modular necktie, in some embodiments, may further comprise: an internal power supply; a microphone; and a transmitter for wirelessly transmitting audio data received via the microphone; wherein the modular necktie is adapted to receive spoken audio data via the microphone and transmit said spoken audio to a receiver.

The modular necktie may be adapted to wirelessly relay digital audio information using Bluetooth® protocols.

The modular necktie may comprise: a simulated knot having a declined rearward surface, the declined rearward surface, the simulated knot affixable to one of a shirt collar and collar band using attachment means, the simulating knot detachably affixable to one of a fabric stem and a tie using attachment means; an internal power supply; a microphone; and a transmitter for wirelessly transmitting audio data received via the microphone.

A second modular necktie is provided comprising: a simulated knot having a declined rearward surface, the simulated knot defining a non-cylindrical attachment channel for receiving a fabric stem, the simulated knot affixable to one of a shirt collar and collar band; a fabric stem adapted to affix at a distal end to an elongated necktie and a proximal end to the knot enclosure, the fabric stem comprising: a noncylindrical proximal head adapted to engage the attachment channel, the proximal head comprising attachment means; a shank; attachment means for affixing to a fabric tie.

The modular necktie may further comprise: an internal power supply; a microphone; and a transmitter for wirelessly transmitting audio data received via the microphone;

wherein the modular necktie is adapted to receive spoken audio data via the microphone and transmit said spoken audio to a receiver.

The modular necktie may be adapted to wirelessly relay digital audio information using Bluetooth® protocols.

In various embodiments, the modular necktie further comprises a decorative faceplate. In other embodiments, the simulated knot is formed from a plurality of interconnected components.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
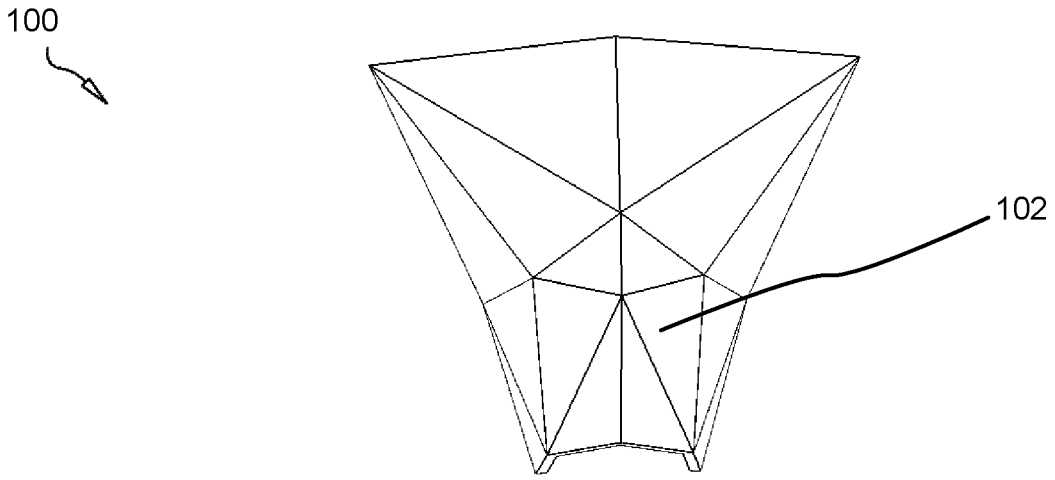
FIG. 1A is a forward perspective view of an interchangeable knot enclosure of modular necktie in accordance with the present invention.

FIG. 1A is a forward perspective view of an interchangeable knot enclosure 100 of modular necktie in accordance with the present invention.

The knot enclosure 100 or knot receptacle comprises a convex exterior surface 102. The exterior surface may be shaped to simulate any knot commonly-known to those of skill in the art, including a Windsor, half-Windsor, Atlantic knot, Nicky knot, small knot, Merovingian knot, and the like. In other embodiments, including that shown, the knot enclosure 100 is faceted in a tapering aesthetically-pleasing style, though not one perfectly simulating common necktie knots. The knot enclosure 100 may form any other generally downwardly-tapering shape.

The knot enclosure 100 may be formed from any polymeric, metallic, fabric or organic material known to those of skill in the art, including Titanium, Aluminum, metal alloy, nylon, leather, woven silk, and the like. The knot enclosure 100 may comprise any decorative exterior surfacing or colors.

Figure 1B:
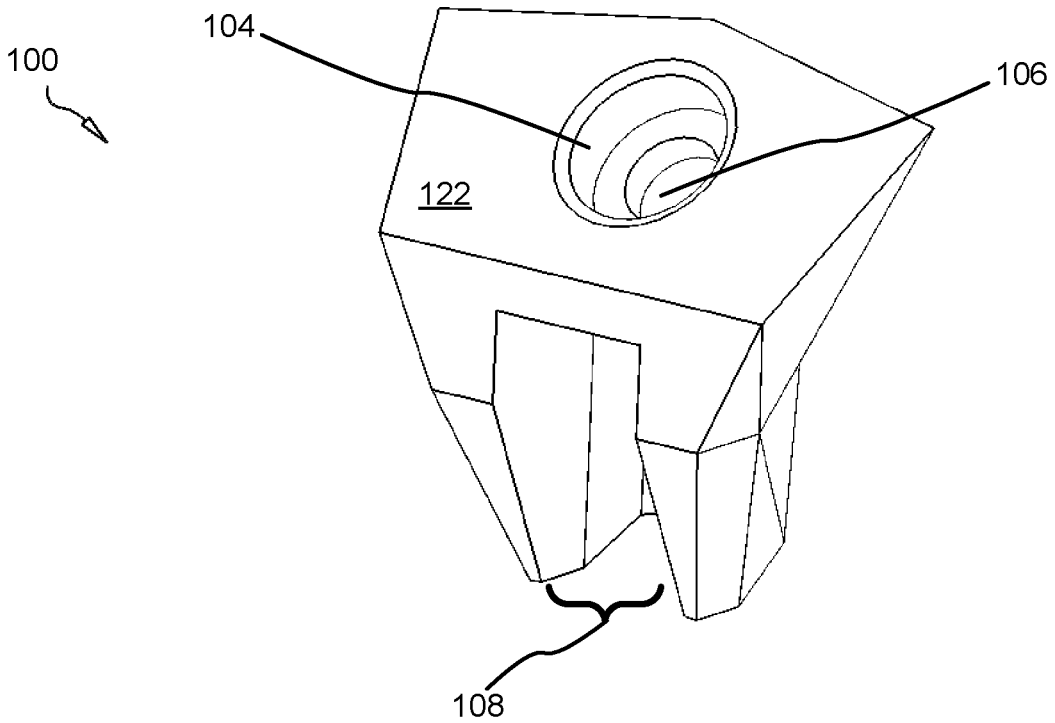
FIG. 1B is an upper, rearward perspective view of an interchangeable knot enclosure of modular necktie in accordance with the present invention.

FIG. 1B is an upper, rearward perspective view of an interchangeable knot enclosure of modular necktie in accordance with the present invention.

The knot enclosure 100 comprises a declined rearward surface 122 defining a cylindrical attachment recess 104. The floor of the cylindrical attachment recess 104 defines a magnetic element recess 106 for receiving a first magnetic element.

The first magnet element may be plated so as to help prevent corrosion and/or to help strengthen the magnet material. In one embodiment, a neodymium magnet is coated with nickel or plastic, yet other options for coatings include zinc, tin, copper, epoxy, silver, and gold, for example.

A cooperating second magnetic element is disposed or positioned on a collar band which may comprise another magnet having an opposite polarity than the first magnetic element. The second magnetic element may comprise a metallic article that is magnetically attracted to the first magnetic element. The first and second magnetic elements may have the same size and shape. In the shown embodiments, the first magnetic element is disc-shaped. One of ordinary skill will recognize that a variety of sizes and/or shapes may be used for the first and second magnetic elements and that the sizes and/or shapes of the two magnetic elements need not be identical.

The knot enclosure 100 defines an attachment channel 108 or socket which is recessed into a lower and/or rearward surface of the knot enclosure 100. The attachment channel 108 is not cylindrical so as to prevent axial rotation of a fabric stem 200 and tie affixed to the knot enclosure 100 within the attachment channel 108.

Figure 2:
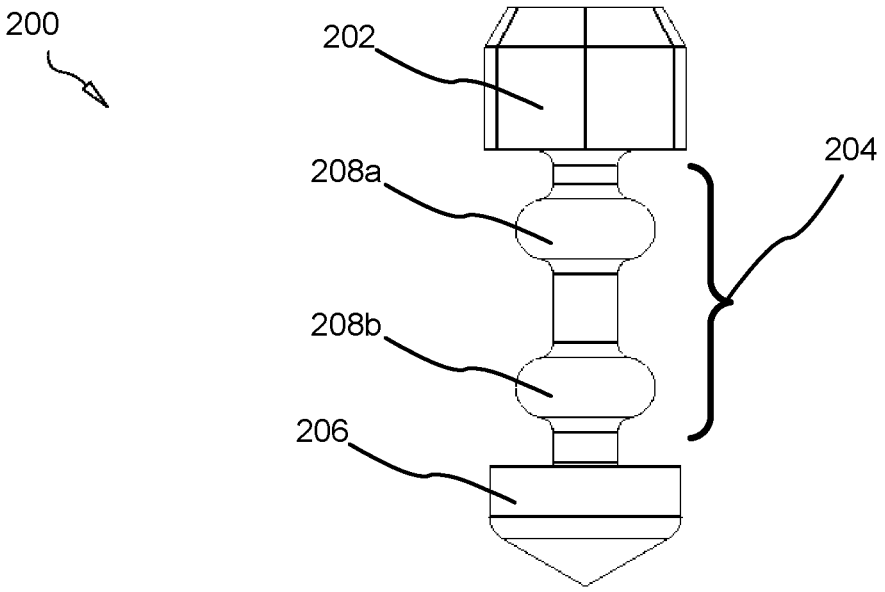
FIG. 2 is a forward perspective view of a detachable fabric stem of modular necktie in accordance with the present invention.

FIG. 2 is a forward perspective view of a detachable fabric stem 200 of modular necktie in accordance with the present invention.

The fabric stem 200 comprises a proximal head 202, a shank 204 having two bulbous flanges 208*a-b*, and a terminal fastener 206 at the distal end of shank 204.

Figure 3:
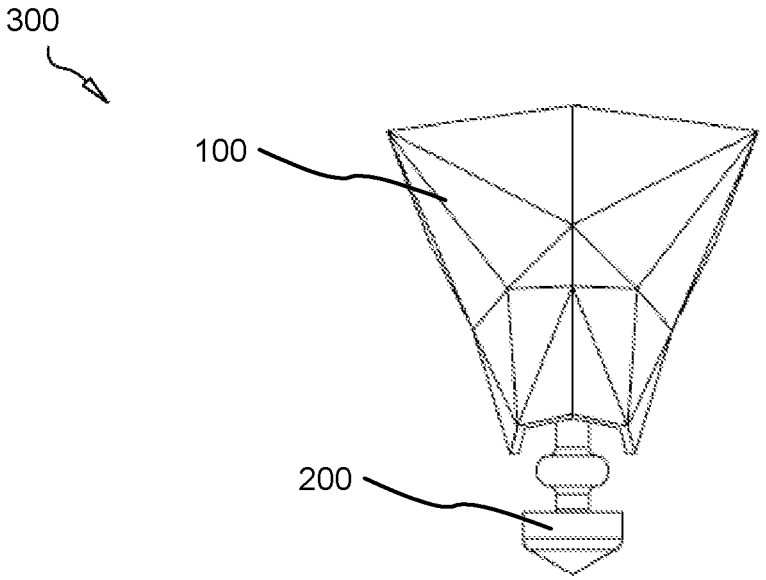
FIG. 3 is a forward perspective view of a modular necktie in accordance with the present invention.

FIG. 3 is a forward perspective view of a modular necktie 300 in accordance with the present invention.

As shown, the fabric stem 200 is detachably inserted into the knot enclosure 100 and engaged within the attachment channel. A fabric tie is affixed about the fabric stem 200 and/or to the terminal end of the fabric stem 200.

Figure 4A:
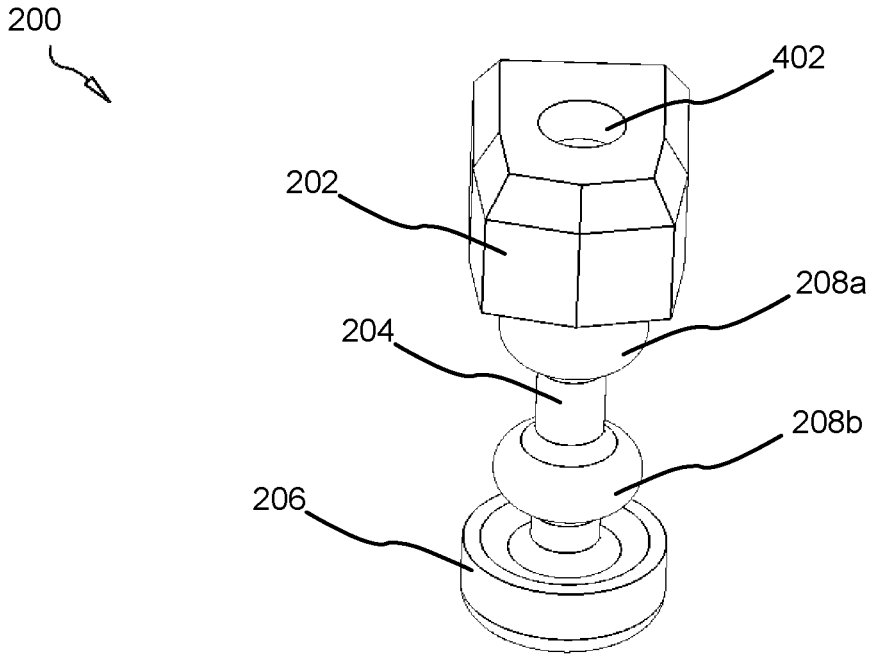
FIG. 4A is an upper, forward perspective view of a detachable fabric stem of a modular necktie in accordance with the present invention.

FIG. 4A is an upper, forward perspective view of a detachable fabric stem 200 of a modular necktie in accordance with the present invention.

The proximal head 202 of the fabric stem 200 is non-cylindrical to prevent axial rotation of the fabric stem 200 within the knot enclosure 100. The proximal head 202 may be tapered upwardly and may comprise a planar top surface defining a hollow cylindrical recess 402 for receiving a magnetic element adapted to engage using magnetic force to a collar band.

The fabric stem 200 comprises a cylindrical shank 204 and terminal fastener 204 at the distal end of the shank 204 for enabling affixation of fabric stem 200 with a fabric tie of elongating fabric material.

The shank 204 may comprise a plurality of bulbous flanges 208*a-b* as shown for further facilitating engagement with a tie.

Figure 4B:
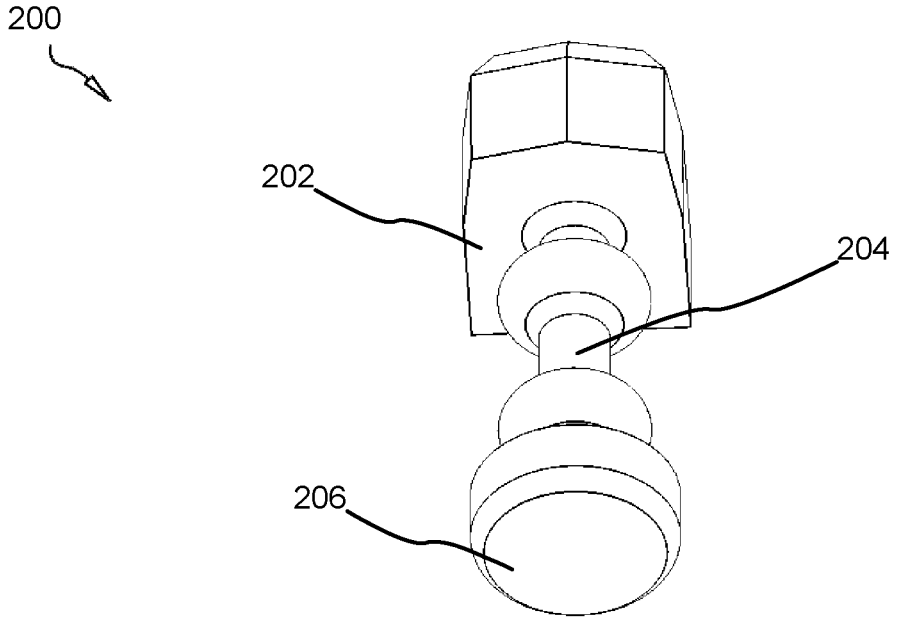
FIG. 4B is a lower, forward perspective view of a detachable fabric stem of a modular necktie in accordance with the present invention.

FIG. 4B is a lower, forward perspective view of a detachable fabric stem of a modular necktie in accordance with the present invention.

The terminal fastener 206 may comprise a planar bottom surface as shown.

Figure 5:
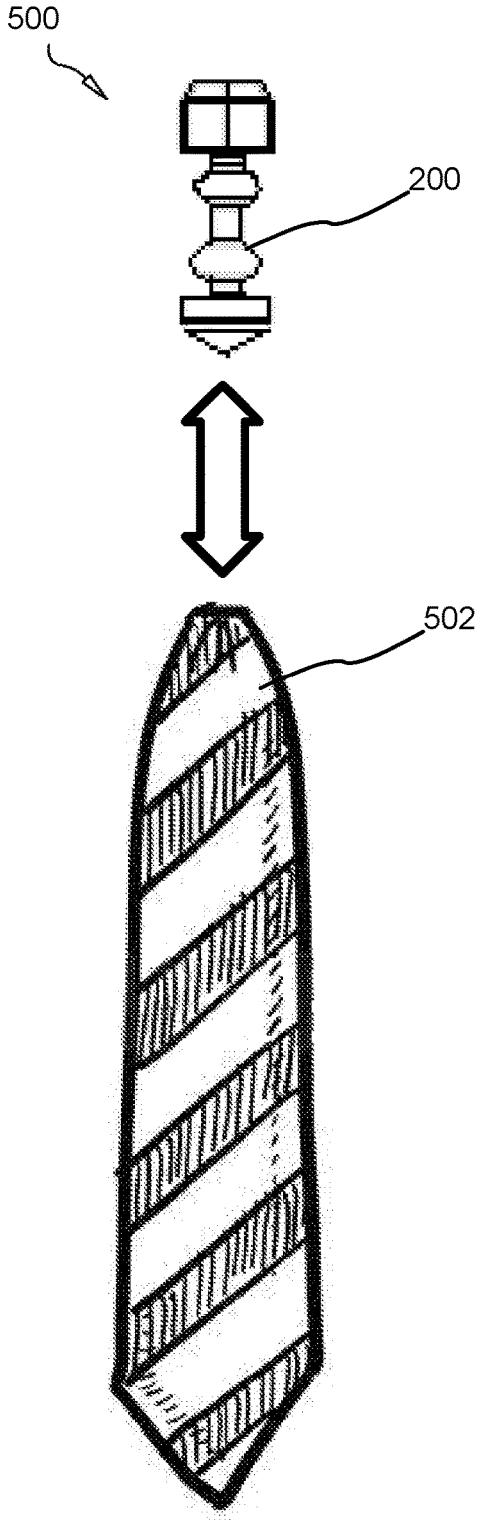
FIG. 5 is a forward perspective view of a disassembled detachable fabric stem and tie of a modular necktie in accordance with the present invention.

FIG. 5 is a forward perspective view of a disassembled detachable fabric stem and tie of a modular necktie in accordance with the present invention.

A tie 502 is affixed to the fabric stem 200. The fabric stem 200 inserts into the tie 502 and/or is enveloped or partially enveloped by the tie 502. The tie 502 may be affixed to the fabric stem 200 using any means known to those of skill in the art, including lashing, a knot, adhesive, or fasteners.

Figure 6:
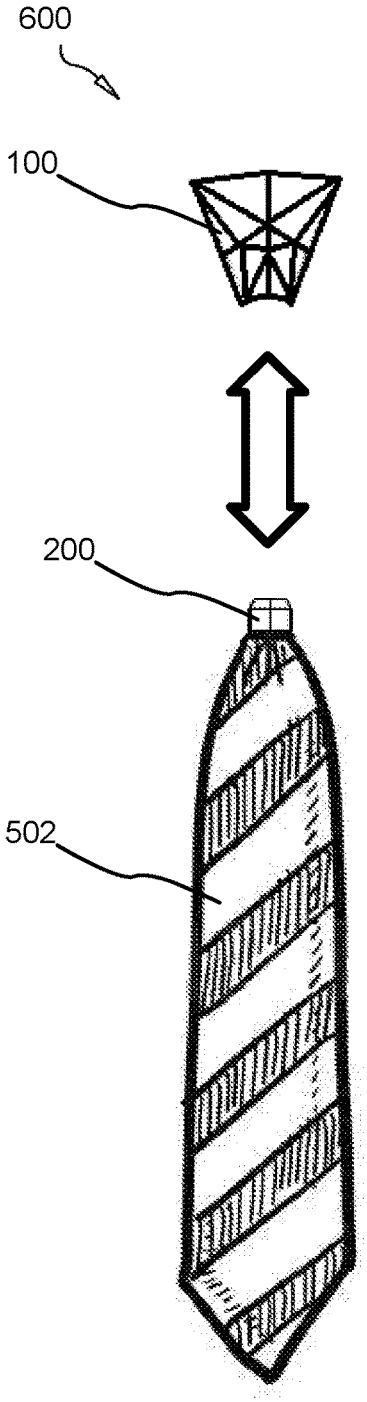
FIG. 6 is a forward perspective view of a disassembled modular necktie in accordance with the present invention.

FIG. 6 is a forward perspective view of a disassembled modular necktie in accordance with the present invention.

The fabric stem 200 is inserted into the tie 502 and the proximal head 202 of the fabric stem 200 positioned and protruding upwardly above the tie 502 for positioning within the attachment channel of the knot enclosure 100.

Figure 7:
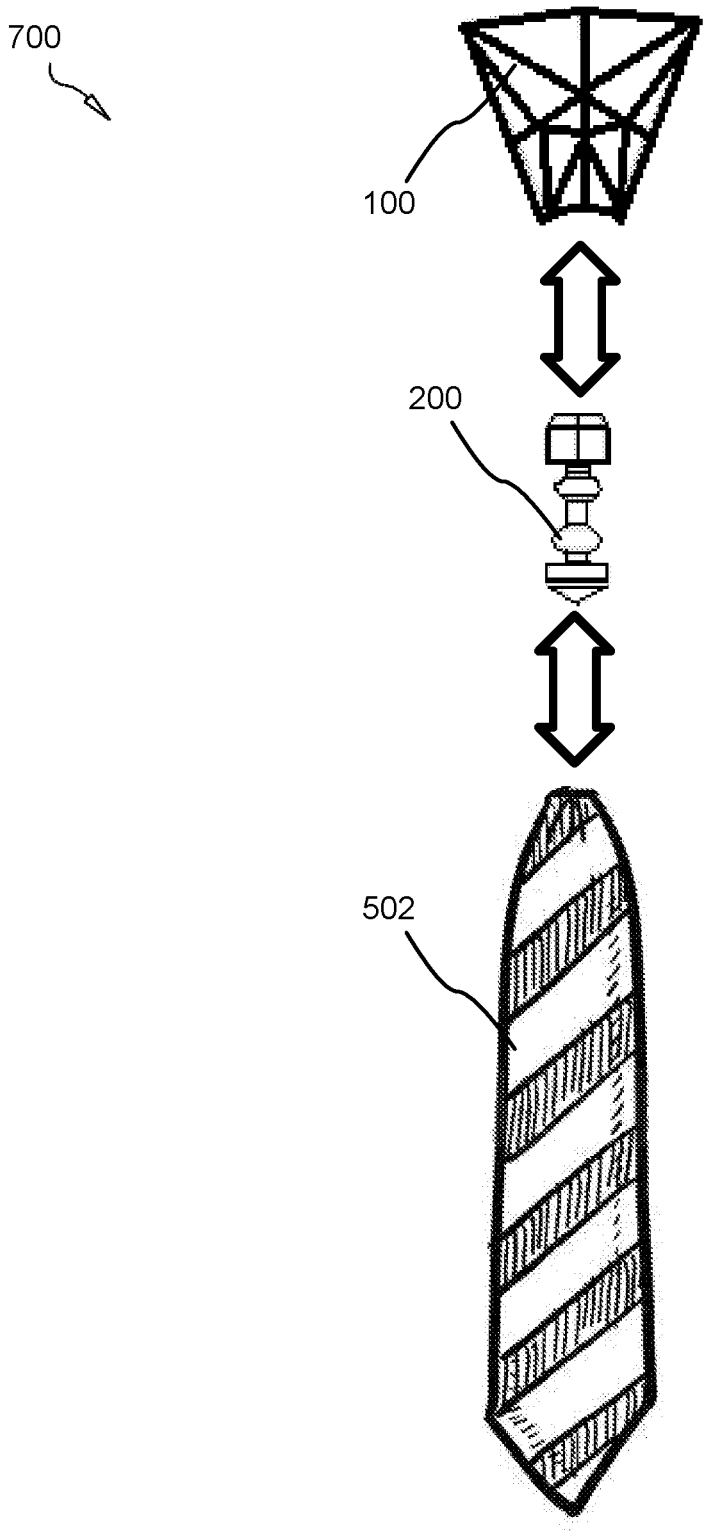
FIG. 7 is a forward perspective view of a disassembled modular necktie in accordance with the present invention.

FIG. 7 is a forward perspective view of a disassembled modular necktie in accordance with the present invention.

The knot enclosure 100, the fabric stem 200, and the tie 502 position together as shown.

Figure 8A:
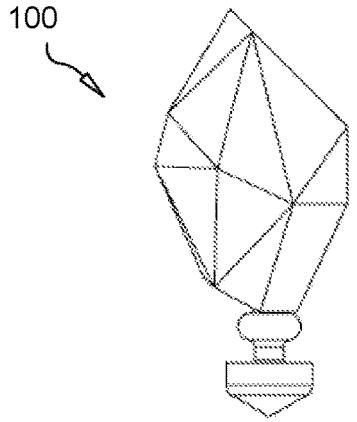
FIG. 8A is a side perspective view of an interchangeable knot enclosure of modular necktie in accordance with the present invention.
Figure 8B:
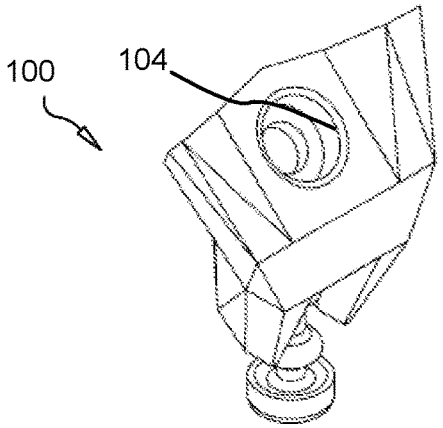
FIG. 8B is an upper, forward perspective view of an interchangeable knot enclosure of modular necktie in accordance with the present invention.
Figure 8C:
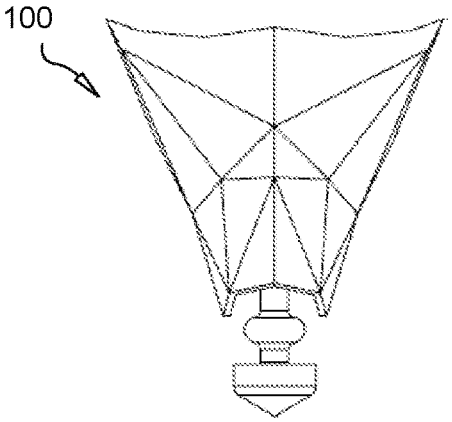
FIG. 8C is a forward perspective view of an interchangeable knot enclosure of modular necktie in accordance with the present invention.
Figure 8D:
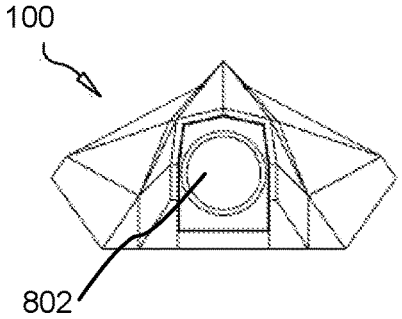
FIG. 8D is an upper perspective view of an interchangeable knot enclosure of modular necktie in accordance with the present invention.
Figure 8E:
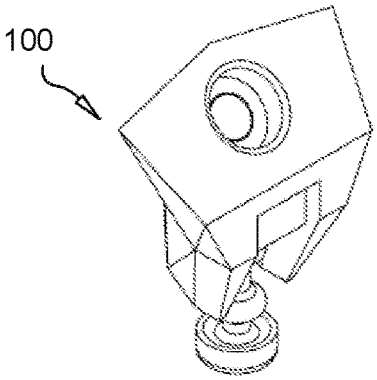
FIG. 8E is an upper, rearward perspective view of an interchangeable knot enclosure of modular necktie in accordance with the present invention.

FIGS. 8A-8 E demonstrate various perspective views of alternate embodiments of interchangeable knot enclosures of modular necktie in accordance with the present invention. The knot enclosure 100 may comprise a magnetic element 802 further described above.

Figure 9:
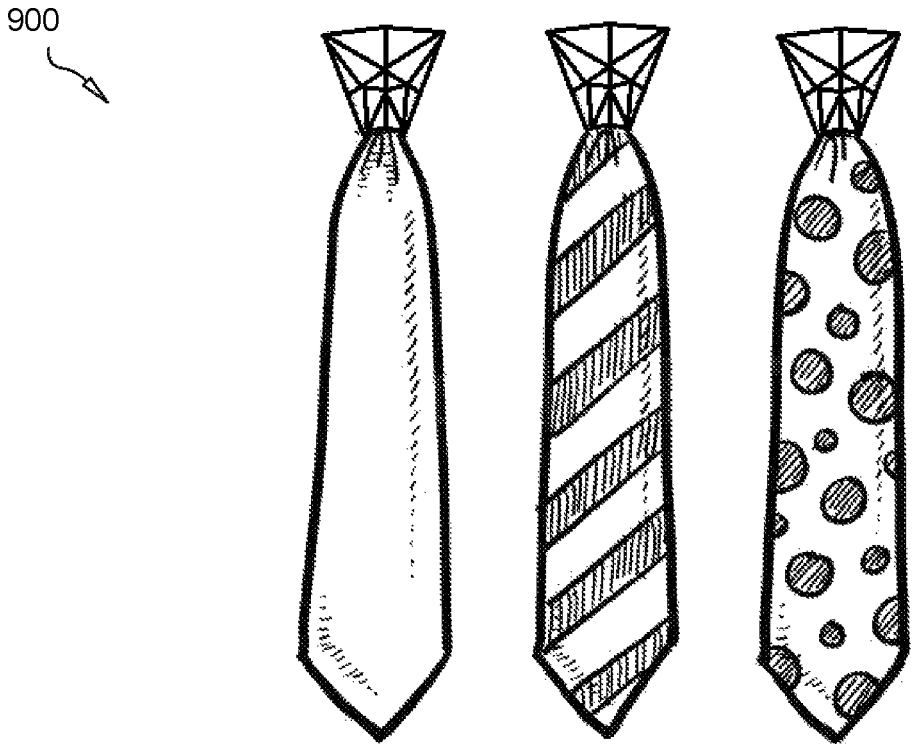
FIG. 9 is a forward perspective view of a collection of three assembled modular neckties in accordance with the present invention.

FIG. 9 is a forward perspective view of a collection of three assembled modular neckties in accordance with the present invention.

The fabric stem 200 is hidden in each assembled modular necktie from the forward perspective.

Figure 10:
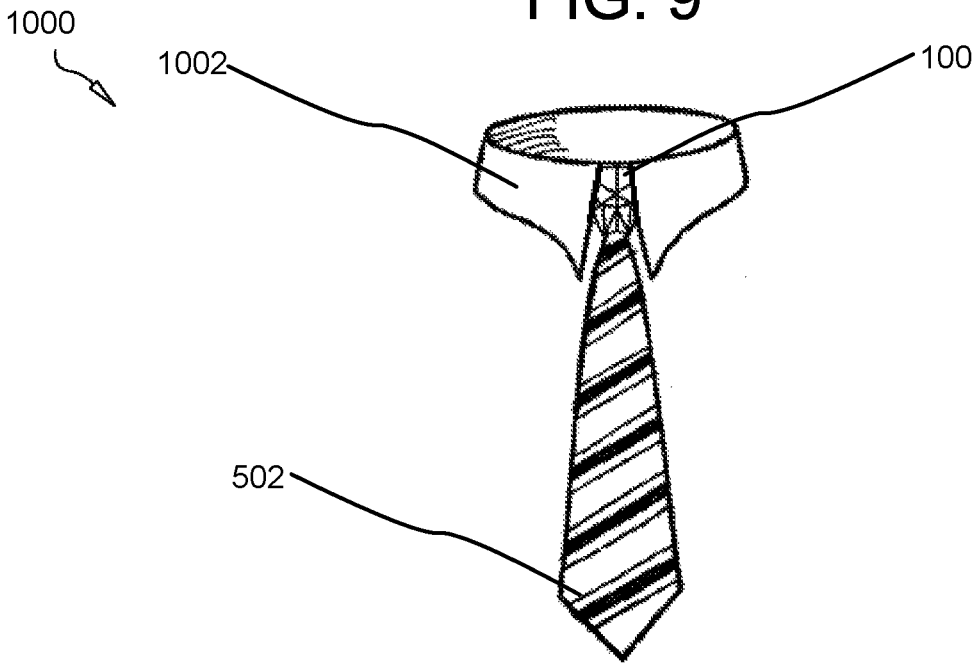
FIG. 10 is an environmental perspective view of a modular necktie in accordance with the present invention.

FIG. 10 is an environmental perspective view of a modular necktie 1000 in accordance with the present invention.

The knot enclosure positions partially behind the collar 1002 of wearer as shown. The modular necktie 1000 positions below the throat of a wearer.

Figure 11A:
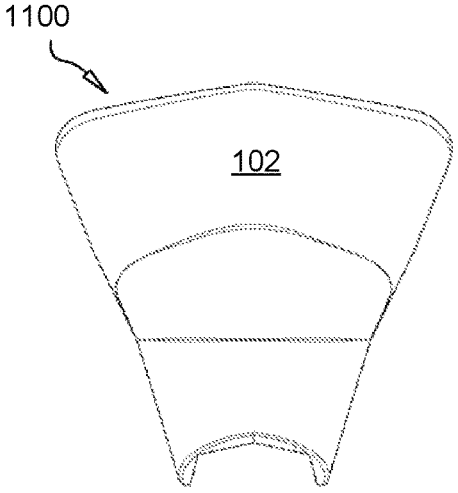
FIG. 11A is a forward perspective view of an interchangeable knot enclosure of modular necktie in accordance with the present invention.
Figure 11B:
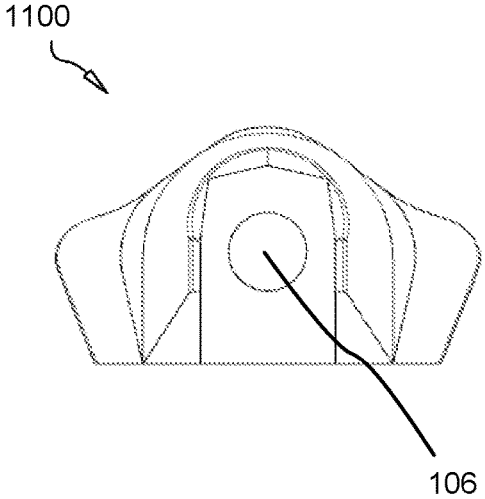
FIG. 11B is an upper perspective view of an interchangeable knot enclosure of modular necktie in accordance with the present invention.

FIGS. 11A-11B illustrate perspective views of an interchangeable knot enclosure 1100 of modular necktie in accordance with the present invention.

The knot enclosure 1100 may comprise smooth outer surfacing/styling as shown.

Figure 12A:
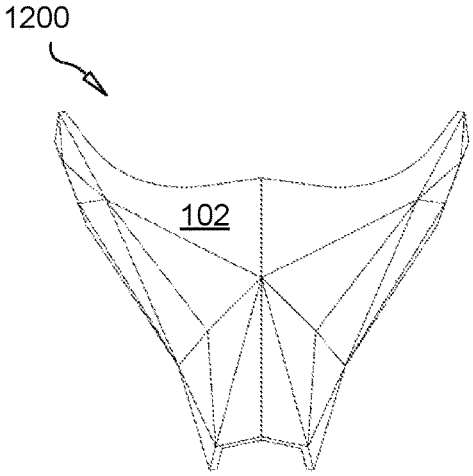
FIG. 12A is a forward perspective view of an interchangeable knot enclosure of modular necktie in accordance with the present invention.
Figure 12B:
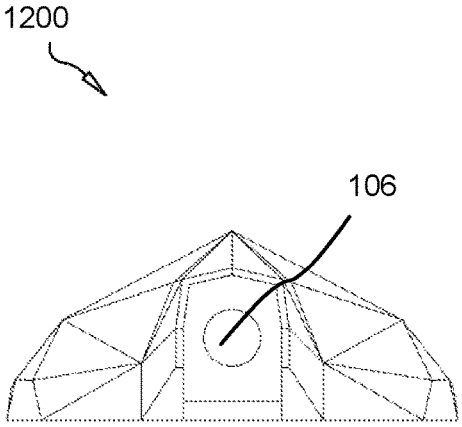
FIG. 12B is an upper perspective view of an interchangeable knot enclosure of modular necktie in accordance with the present invention.

FIGS. 12A-12B illustrate perspective views of an interchangeable knot enclosure of modular necktie in accordance with the present invention.

The knot enclosure 1100 may comprise laterally-rising wings as shown for increased projection into a wearer's collar.

Figure 13A:
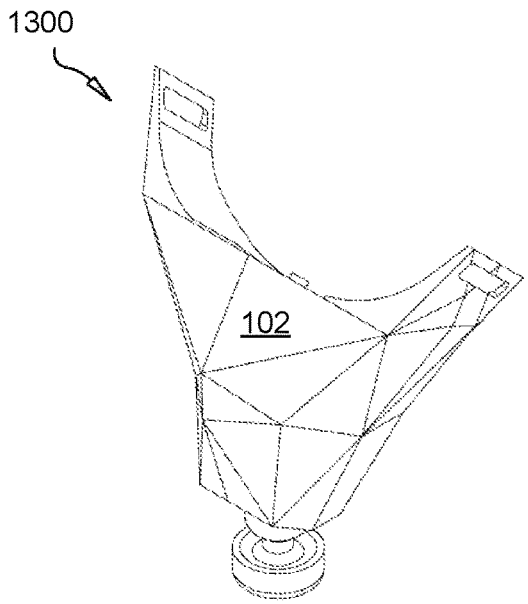
FIG. 13A is an upper, forward perspective view of an interchangeable knot enclosure of modular necktie in accordance with the present invention.
Figure 13B:
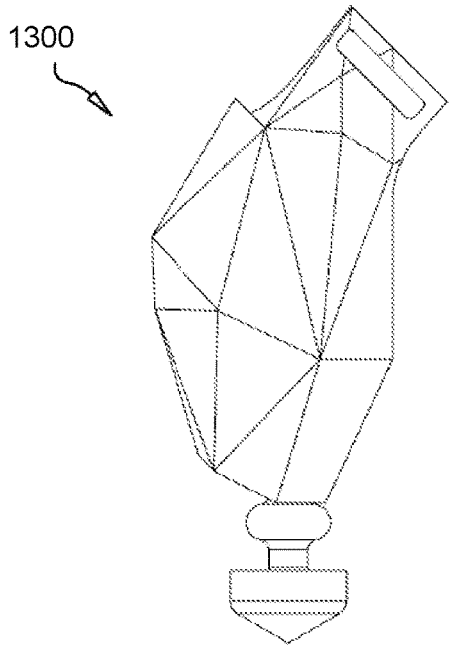
FIG. 13B is a side perspective view of an interchangeable knot enclosure of modular necktie in accordance with the present invention.
Figure 13C:
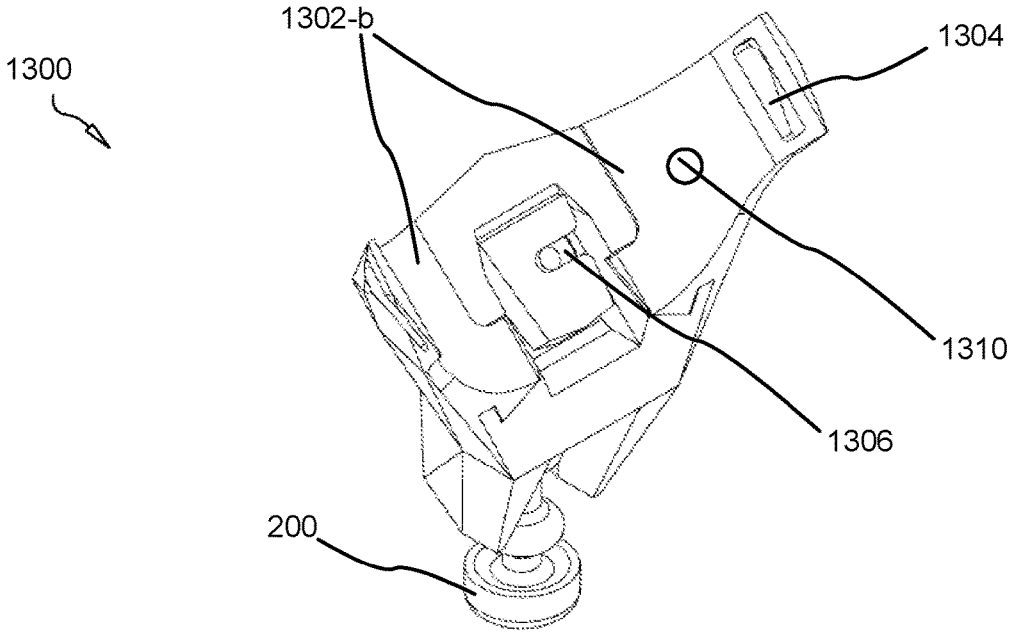
FIG. 13C is a side, rearward perspective view of an interchangeable knot enclosure of modular necktie in accordance with the present invention.

FIG. 13A-13C illustrate perspective views of an interchangeable knot enclosure 1300 of modular necktie in accordance with the present invention.

The knot enclosure 1300 comprises two detachable lateral collar wings 1302 having collar band fasteners 1304. The lateral collar wings 1302 engage the knot enclosure 1300 using attachment means 1306 as shown.

Figure 14:
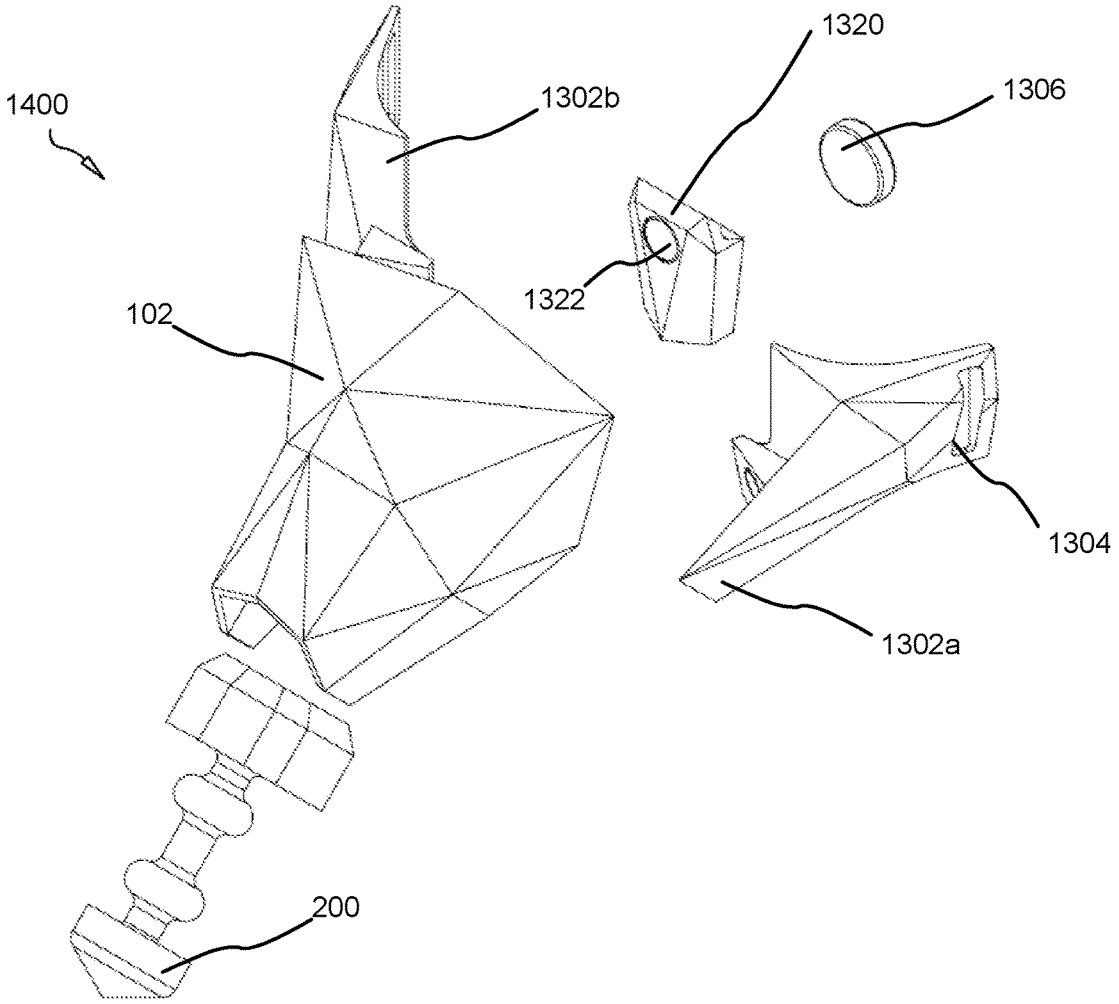
FIG. 14 is a disassembled perspective view of an interchangeable knot enclosure of modular necktie in accordance with the present invention.

FIG. 14 is a disassembled perspective view of an interchangeable knot enclosure of modular necktie in accordance with the present invention.

The knot enclosure 1400 affixed to a button 1306 on a shirt of a wearer suing button attachment means 1320 which comprises a magnetic element 1322.

The knot enclosure 1400 comprises two lateral collar wings 1302 for inserted under the collar of the shirt of a wearer. These lateral collar wings 1302*a-b* may define a band fastener 1304 for affixing to a collar band circumscribing the neck of a wearer. The lateral collar wings 1302 may affix to the knot enclosure 1400 using a friction fit, snap-fit, screws, or other attachment means.

Figure 15:
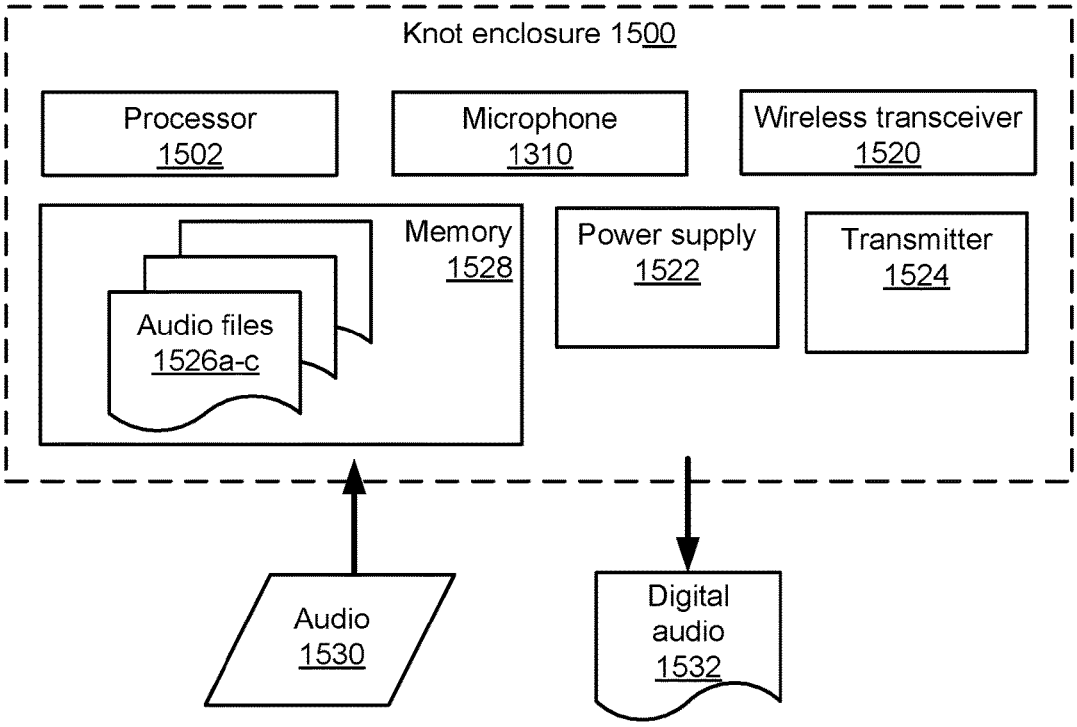
FIG. 15 is a block diagram illustrating interior electrical components of a knot enclosure of modular necktie in accordance with the present invention.

FIG. 15 is a block diagram illustrating interior electrical components of a knot enclosure 1500 of modular necktie in accordance with the present invention.

The enclosure 1500 may comprises a processor 1502, a wireless transceiver 1520, a microphone 1310, a power supply 1522, a wireless transmitter 1524, and a memory 1528 comprising a plurality of audio files 1526*a-c*.

In various embodiments, audio input 1530 is received by microphone 1310 and spoken by a wearer. This audio may be retransmitted using protocols and means known to those of skill in the art, including BlueTooth® to a remote data processing device (DPD) such as a tablet computer, smart phone, server, personal computer, amplifier, and the like. In various embodiments, the remote DPD is in wireless connectivity with the knot enclosure 1500 via a local area network (LAN) or wide area network (WAN). The data output is noticed at 1532.

The knot enclosure 1500 may comprise means for relaying electrical signals enabling device-to-device communication (meaning wireless transmission of media). The knot enclosure 1500 may be configured to make use of the Bluetooth® protocols and procedures enabling device-to-device intercommunication connectivity. This functionality may be provided by incorporating the Bluetooth Intercom Profile® and/or the Bluetooth Telephony Profile®, or other wireless technologies known to those of skill in the art.

This communication may be in accordance with core specifications of one or more subsets of Bluetooth® profiles, wherein the core specifications comprise one or more of: the Cordless Telephony Profile (CTP), the Device ID Profile (DIP), the Dial-up Networking Profile (DUN), the File Transfer Profile (FTP), the Hands-Free Profile (HFP), the Human Interface Device Profile (HID), the Headset Profile (HSP), and the Intercom Profile (ICP), the Proximity Profile (PXP).

Figure 16:
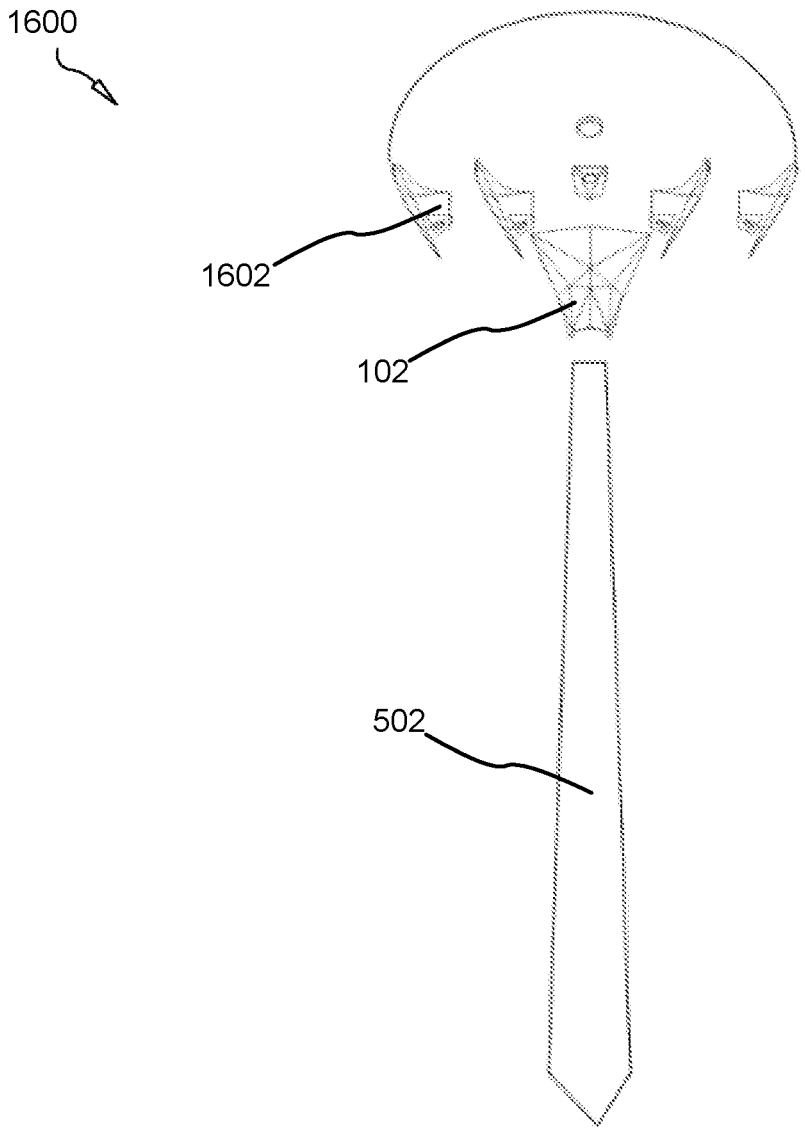
FIG. 16 is a forward perspective view of a disassembled modular necktie in accordance with the present invention.

FIG. 16 is a forward perspective view of a disassembled modular necktie 1600 in accordance with the present invention.

The tie enclosure 102 may be formed as a single integrated piece or may comprise a plurality of interlocking or interconnecting components 1602 as shown.

Figure 17A:
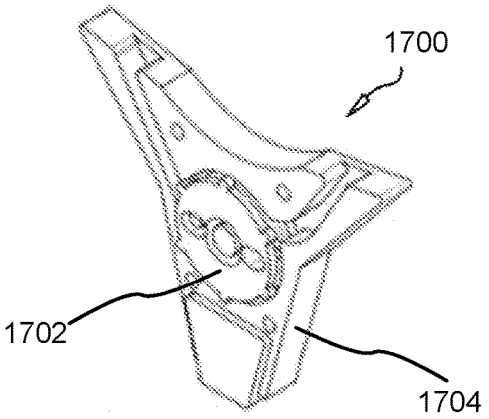
FIG. 17A is a side perspective view of a disassembled modular necktie in accordance with the present invention.

FIG. 17A is a side perspective view of a disassembled modular necktie 1700 in accordance with the present invention.

In various embodiments, the modular necktie 1700 comprises a ratcheting mechanism 1702 adapted to allow an interconnected collar band to be ratcheted tighter.

Figure 17B:
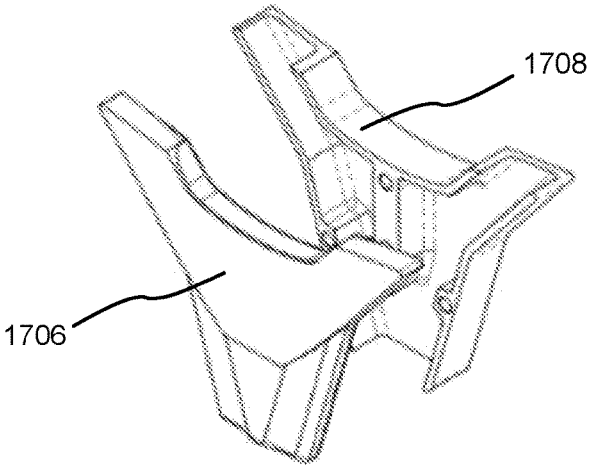
FIG. 17B is a side perspective view of a disassembled modular necktie in accordance with the present invention.

FIG. 17B is a side perspective view of a disassembled modular necktie in accordance with the present invention.

In some embodiments, the modular necktie 1700 comprises a forward housing 1706 and a rearward housing 1708 which are snapped, screwed, or otherwise affixed together over the ratcheting mechanism 1702 and/or other interior components of the modular necktie 1700.

Figure 17C:
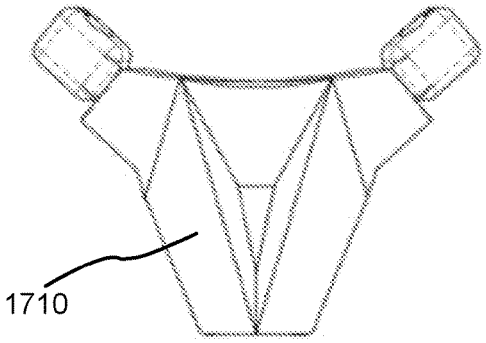
FIG. 17C is a side perspective view of a disassembled modular necktie in accordance with the present invention.

FIG. 17C is a side perspective view of a disassembled modular necktie in accordance with the present invention.

As shown.

Figure 17D:
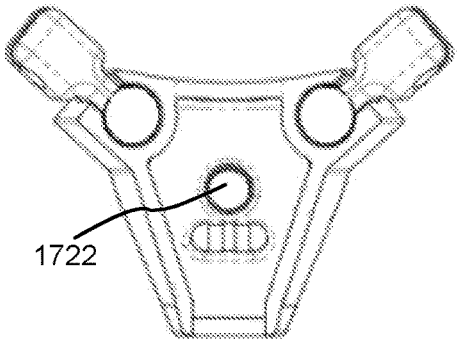
FIG. 17D is a side perspective view of a disassembled modular necktie in accordance with the present invention.

FIG. 17D is a side perspective view of a disassembled modular necktie in accordance with the present invention.

The modular necktie 1700 may comprise an embedded magnet 1722 for attaching a decorative faceplate.

Figure 18:
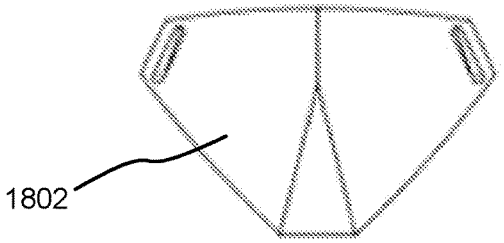
FIG. 18 is a forward perspective view of a tie triangle in accordance with the present invention.

FIG. 18 is a forward perspective view of a decorative faceplate 1802 in accordance with the present invention.

The decorative faceplate 1802 may be affixed using magnets 1722 to the front of modular tie 1700. The faceplate 1802 may be varied in color and stylizing in accordance with the preferences of a wearer.

Figure 19:
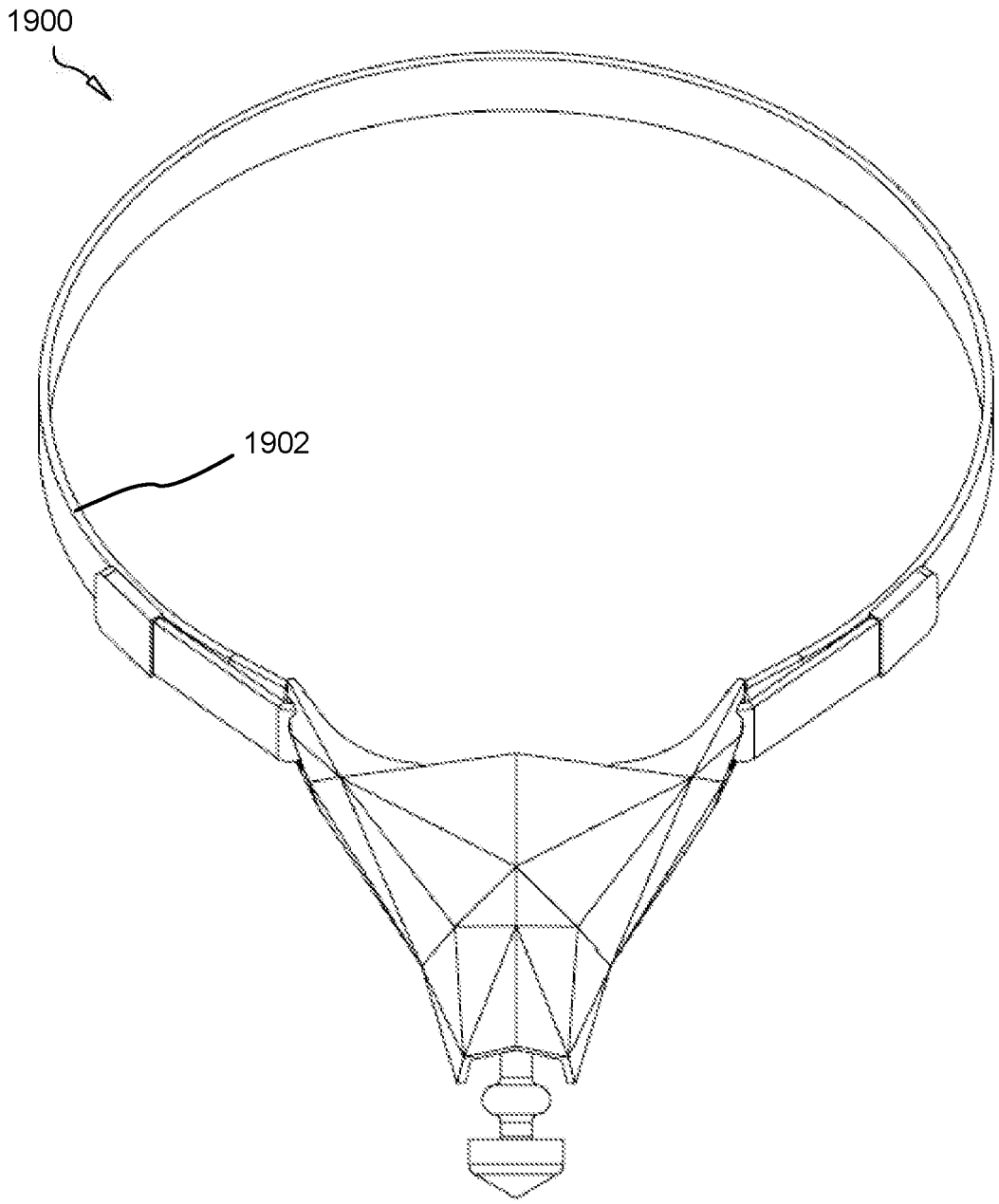
FIG. 19 is a forward perspective view of a modular necktie in accordance with the present invention.

FIG. 19 is a forward perspective view of a modular necktie 1900 in accordance with the present invention.

The modular necktie 1900 may comprise an uninterrupted collar band 1902 as shown.

Figure 20:
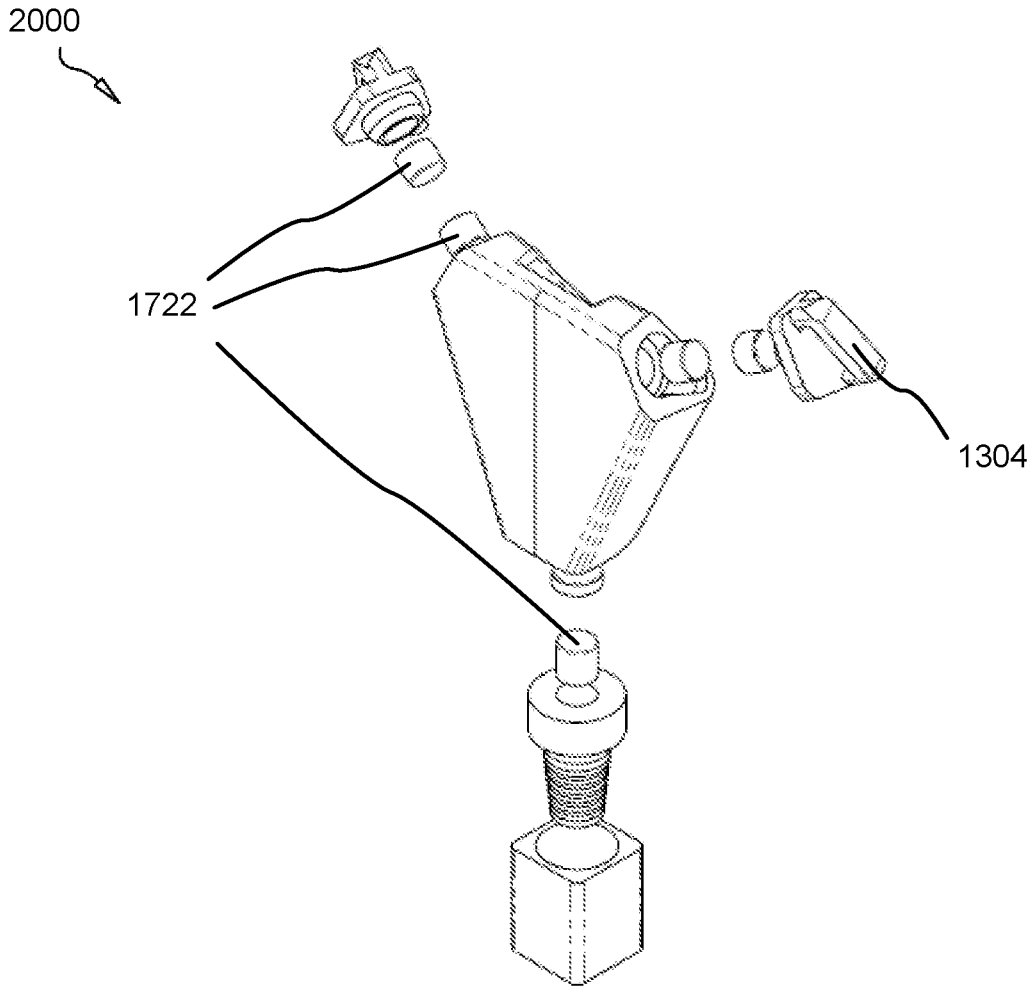
FIG. 20 is a side forward perspective view of a disassembled modular necktie in accordance with the present invention.

FIG. 20 is a side forward perspective view of a disassembled modular necktie 2000 in accordance with the present invention.

The modular necktie 2000 comprises a plurality of magnets 1722 for holding components of the modular necktie 1900 together as shown.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular necktie comprising:

a knot enclosure that is formed of a polymeric or metallic material, the knot enclosure having a top edge, a bottom edge opposite the top edge, a front surface, and a rear surface opposite the front surface, the knot enclosure including an attachment channel that extends vertically within the knot enclosure and includes an opening at the bottom edge;

a fabric stem having a proximal head and a distal end that is coupled to the proximal head via a shank, the proximal head including a magnet that interlocks with a magnet contained in at least one surface within the attachment channel when the proximal head is inserted into the attachment channel to thereby secure the fabric stem to the knot enclosure; and a tie portion that is formed of a fabric material, the tie portion being secured to the shank of the fabric stem such that the tie portion extends downwardly from the knot enclosure when the magnet included in the proximal head of the fabric stem is interlocked with the magnet contained in the at least one surface within the attachment channel.

2. The modular necktie of claim 1, wherein the magnet included in the proximal head of the fabric stem is contained within a proximal surface of the proximal head.

3. A modular necktie comprising:

a knot enclosure that is formed of a polymeric or metallic material, the knot enclosure having a top edge, a bottom edge opposite the top edge, a front surface, and a rear surface opposite the front surface, the knot enclosure including an attachment channel that extends vertically within the knot enclosure and includes an opening at the bottom edge;

a fabric stem having a proximal head and a distal end that is coupled to the proximal head via a shank, the proximal head being configured to interlock with multiple surfaces within the attachment channel when the proximal head is inserted into the attachment channel to thereby secure the fabric stem to the knot enclosure; and a tie portion that is formed of a fabric material, the tie portion being secured around the shank of the fabric stem such that the tie portion extends downwardly from the knot enclosure when the proximal head of the fabric stem is interlocked with the at least one surface within the attachment channel.

4. The modular necktie of claim 3, further comprising:

a collar band that is secured at opposing sides of the top edge of the knot enclosure, the collar band being configured to circumscribe a wearer's neck to maintain the knot enclosure at a collar of the wearer's shirt.

5. The modular necktie of claim 4, further comprising:

lateral collar wings that are positioned at the opposing sides of the top edge of the knot enclosure, the collar band being secured to the lateral collar wings.

6. The modular necktie of claim 3, wherein the knot enclosure includes laterally-rising wings.

7. The modular necktie of claim 3, wherein the front surface of the knot enclosure includes a plurality of angled surfaces.

8. The modular necktie of claim 3, wherein the knot enclosure includes means for coupling the knot enclosure to a top button of a wearer's shirt.

9. The modular necktie of claim 3, wherein the knot enclosure further includes decorative exterior surfacing.

10. The modular necktie of claim 3, wherein the knot enclosure is formed of a polymeric material.

11. The modular necktie of claim 3, wherein the knot enclosure is formed of a metallic material.

12. The modular necktie of claim 3, wherein the knot enclosure houses one or more electrical components.

13. The modular necktie of claim 12, wherein the one or more electrical components comprise a microphone.

14. The modular necktie of claim 12, wherein the one or more electrical components comprise memory for storing audio files.

15. A modular necktie comprising:

a knot enclosure having a top edge, a bottom edge opposite the top edge, a front surface, and a rear surface opposite the front surface, the knot enclosure including an attachment channel that extends vertically within the knot enclosure and includes an opening at the bottom edge, the knot enclosure including one or more attachment channel magnets contained in at least one surface within the attachment channel;

a first fabric stem having a first proximal head and a first distal end that is coupled to the first proximal head via a first shank, the first proximal head including a first magnet that interlocks with the one or more attachment channel magnets when the first proximal head is inserted into the attachment channel to thereby secure the first fabric stem to the knot enclosure;

a first tie portion that is formed of a fabric material, the first tie portion being secured to the first shank of the first fabric stem such that the first tie portion extends downwardly from the knot enclosure when the first magnet included in the first proximal head of the first fabric stem is interlocked with the one or more attachment channel magnets;

a second fabric stem having a second proximal head and a second distal end that is coupled to the second proximal head via a second shank, the second proximal head including a second magnet that interlocks with the one or more attachment channel magnets when the second proximal head is inserted into the attachment channel to thereby secure the second fabric stem to the knot enclosure; and a second tie portion that is formed of a fabric material, the second tie portion being secured to the second shank of the second fabric stem such that the second tie portion extends downwardly from the knot enclosure when the second magnet included in the second proximal head of the second fabric stem is interlocked with the one or more attachment channel magnets.

16. The modular necktie of claim 15, wherein the front surface of the knot enclosure includes a plurality of angled surfaces.

17. The modular necktie of claim 15, wherein the knot enclosure further includes decorative exterior surfacing.

18. The modular necktie of claim 15, wherein the knot enclosure houses one or more electrical components.

19. The modular necktie of claim 15, wherein the knot enclosure includes means for coupling the knot enclosure to a top button of a wearer's shirt.

20. The modular necktie of claim 15, wherein the knot enclosure is formed of a polymeric or metallic material.

* * * * *